US006474489B2

(12) United States Patent
Payne et al.

(10) Patent No.: US 6,474,489 B2
(45) Date of Patent: Nov. 5, 2002

(54) COLLISION ATTENUATOR

(76) Inventors: Thomas S. Payne, 32205 Allison Dr., Union City, CA (US) 94587; James M. Payne, 3721 Knox Ave., Rosamond, CA (US) 93560

( * ) Notice: Subject to any disclaimer, the term of this patent is extended or adjusted under 35 U.S.C. 154(b) by 0 days.

(21) Appl. No.: 09/753,540

(22) Filed: Jan. 2, 2001

(65) Prior Publication Data

US 2001/0007316 A1 Jul. 12, 2001

Related U.S. Application Data

(63) Continuation-in-part of application No. 09/267,028, filed on Mar. 12, 1999, now abandoned.

(51) Int. Cl.[7] ..... B61G 11/00
(52) U.S. Cl. ..... 213/221; 105/392.5; 105/393
(58) Field of Search ..... 213/220, 221, 213/222, 223; 105/392.5, 393; 293/102, 120, 133, 107

(56) References Cited

U.S. PATENT DOCUMENTS

| | | | | |
|---|---|---|---|---|
| 533,418 | A | | 1/1895 | Richards |
| 616,395 | A | | 12/1898 | Bedford |
| 625,603 | A | | 5/1899 | Prophitt |
| 854,290 | A | * | 5/1907 | Hale ..... 213/221 |
| 4,715,292 | A | | 12/1987 | Pavlick et al. |
| 5,052,732 | A | | 10/1991 | Oplet et al. |
| 5,199,755 | A | | 4/1993 | Getz |
| 5,619,931 | A | | 4/1997 | Madison |
| 5,697,657 | A | | 12/1997 | Unrath |
| 5,725,265 | A | | 3/1998 | Barber |
| 5,810,427 | A | | 9/1998 | Hartmann et al. |
| 6,039,349 | A | | 3/2000 | Laporte et al. |
| 6,056,336 | A | * | 5/2000 | Balgobin ..... 293/107 |
| 6,106,038 | A | | 8/2000 | Dreher |
| 6,293,205 | B1 | | 9/2001 | Butler |

* cited by examiner

*Primary Examiner*—Mark T. Le
(74) *Attorney, Agent, or Firm*—Dorsey & Whitney LLP

(57) ABSTRACT

A train collision attenuator mounted on a leading end of a train for attenuating the force of impact between a moving train and a pedestrian or motor vehicle. The train collision attenuator includes an energy absorbing assembly and a mounting assembly. The energy absorbing assembly includes a leading surface and the energy absorbing assembly is dimensioned and configured for attenuating the force of impact between the moving train and the pedestrian located in the path of the moving train as the pedestrian impacts against the leading surface. The mounting assembly secures the energy absorbing assembly to the leading end of the train. A lifting mechanism for moving the energy absorbing assembly between a deployed position to a retracted position is also provided. A selectively-inflatable, externally-mounted airbag including an upper pedestrian cushioning portion and a lower pedestrian support portion is also provided. An energy absorbing hydraulic cylinder and a vehicle contact plate mounted on the hydraulic cylinder piston is also provided.

15 Claims, 11 Drawing Sheets

COLLISION ATTENUATOR

RELATED APPLICATIONS

This application is a Continuation-in-Part of U.S. patent application Ser. No. 09/267,028 filed Mar. 12, 1999, now abandoned, the entire contents of which is incorporated herein by this reference.

BACKGROUND OF THE INVENTION

1. Field of the Invention

This invention relates to railroad trains and, more particularly, to collision safety equipment located at the front of the railroad train.

2. Description of Related Art

A railroad train at full speed is difficult to stop and of course cannot be steered to avoid a collision with a pedestrian or motor vehicle. Most railroad trains are also extremely heavy relative to a motor vehicle, even a truck or bus. The front or leading train car, for example a locomotive of a train, is typically constructed of a large rigid steel structure and significantly outweighs anything likely to cross a railroad track. Because of this, emphasis to date has been on preventing pedestrians and motor vehicles from crossing or stopping on railroad tracks in the path of an oncoming train. However, collisions between pedestrians or motor vehicles with trains are still a significant problem and often result in fatalities for the pedestrians or for the occupants of the motor vehicles.

Current collision prevention efforts include warning devices on each train such as horns and lights, and warnings and barriers at railway and pedestrian or motor vehicle crossings. Also, fencing is typically used along railroad right of ways to restrict access by pedestrians and/or motor vehicles. Unfortunately, pedestrians and drivers accidentally miss, ignore, or deliberately circumvent these warning systems.

An exemplar of a prior device for reducing the severity of injuries in accidents between a compact vehicle and a pedestrian is U.S. Pat. No. 5,810,427 to Hartmann et al.

Prior devices for prior crash attenuating the energy of impact between a truck and another motor vehicle are disclosed by U.S. Pat. Nos. 5,697,657 to Unrath, Sr., U.S. Pat. No. 5,199,755 to Gertz, and U.S. Pat. No. 5,052,732 to Oplet et al.

SUMMARY OF THE INVENTION

In summary, one aspect of the present invention is directed to a train collision attenuator mounted on a leading end of a train for attenuating the force of impact between a moving train and a pedestrian. The includes an energy absorbing assembly and a mounting assembly. The energy absorbing assembly includes a leading surface and the energy absorbing assembly is dimensioned and configured for attenuating the force of impact between the moving train and the pedestrian located in the path of the moving train as the pedestrian impacts against the leading surface. The mounting assembly secures the energy absorbing assembly to the leading end of the train.

Another aspect of the present invention is directed to a lifting mechanism for moving the energy absorbing assembly between a deployed position to a retracted position.

Another aspect of the present invention is directed to a selectively-inflatable, externally-mounted airbag including an upper pedestrian cushioning portion and a lower pedestrian support portion.

Another aspect of the present invention is directed to an energy absorbing hydraulic cylinder and a vehicle contact plate mounted on the hydraulic cylinder piston.

An object of the present invention is to reduce the severity of train collisions with pedestrians and motor vehicles.

Another object of the present invention is to provide an apparatus for attenuating the force of impact between a moving train and a pedestrian.

Yet another object of the present invention is to provide an apparatus for attenuating the force of impact between a moving train and another vehicle.

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
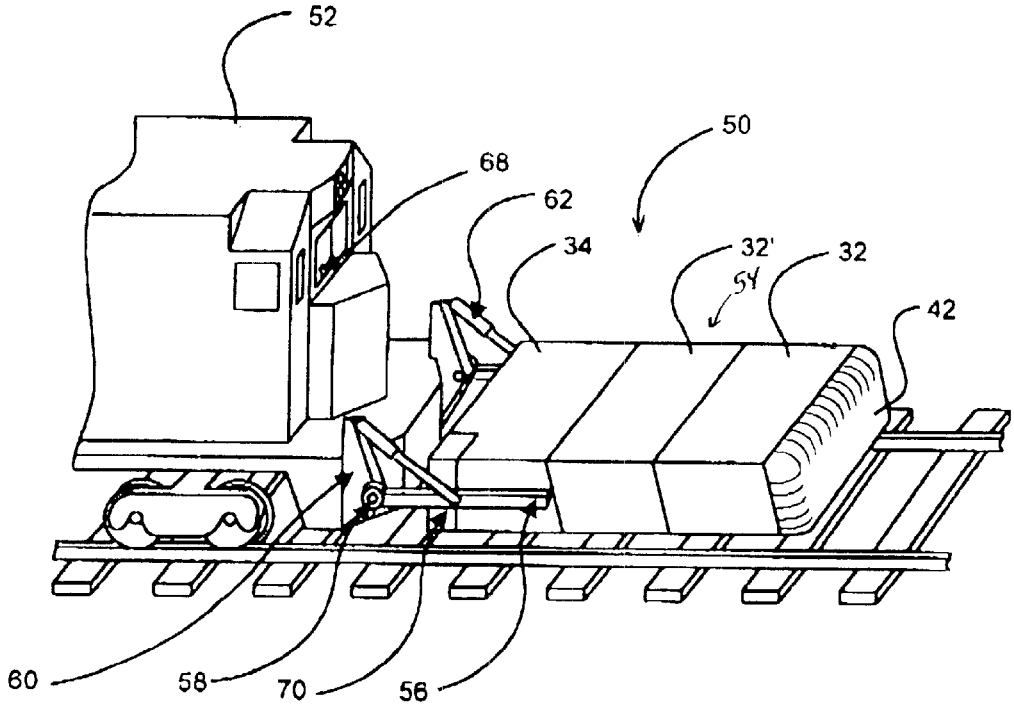
FIG. 1 is a perspective view of a collision attenuator mounted on the front of a train locomotive in accordance with the present invention.
Figure 2:
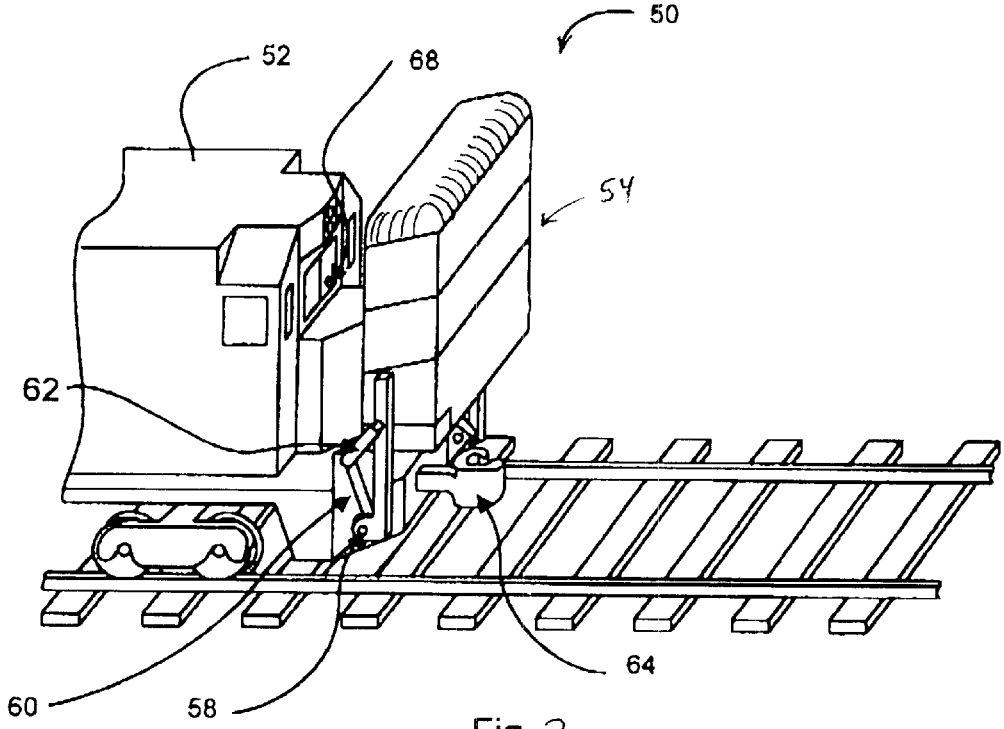
FIG. 2 is a perspective view of the collision attenuator of FIG. 1 pivoted to an upright position.
Figure 3:
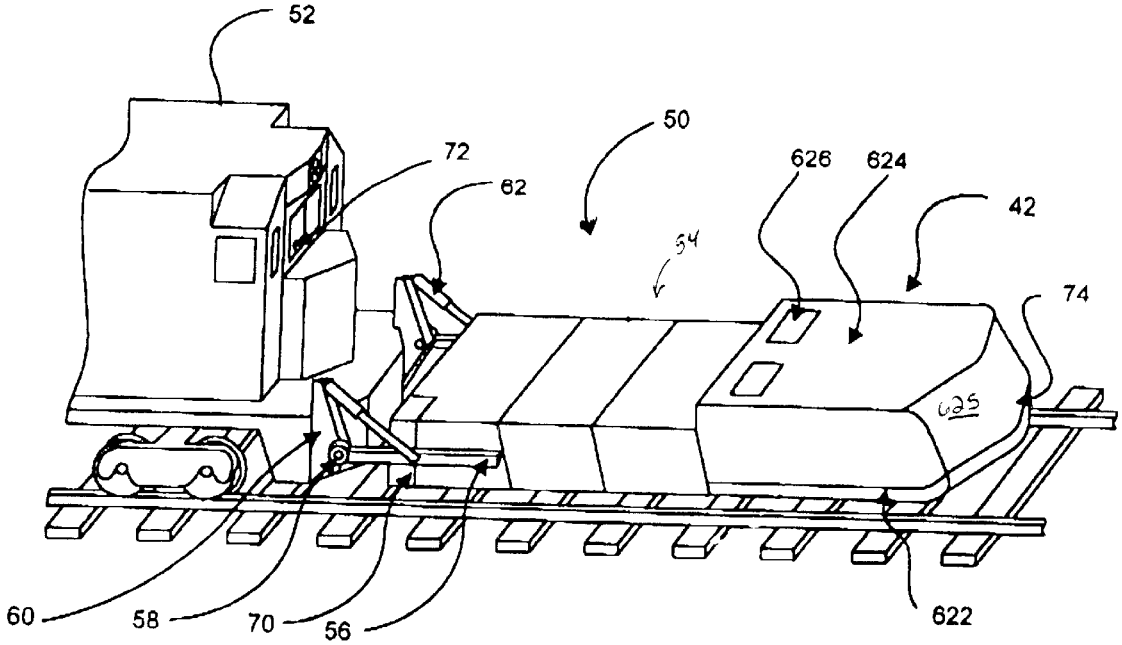
FIG. 3 is a perspective view of the collision attenuator of FIG. 1 showing an airbag in a deployed position.

Turning now to the drawings, wherein like components are designated by like reference numerals throughout the various figures, attention is directed to FIGS. 1–3. A train collision attenuator 50 in accordance with the present invention generally includes an energy absorbing assembly and a mounting assembly for attachment to a train, namely a train car and/or locomotive. In operation and use, the collision attenuator is positioned in a deployed position such that, in the event that a pedestrian or a vehicle crosses a railway in the path of the train, the pedestrian or vehicle with contact the energy absorbing assembly. The energy absorbing assembly will collapse, slowly decelerating and/or accelerating the pedestrian or vehicle and significantly reduce collision forces experienced by the pedestrian or vehicle.

FIG. 1, shows a train collision attenuator 50 mounted directly on a leading rail car of a train, specifically a train engine or locomotive 52. For the purpose of clarity, leading rail car refers to the first rail car with respect to the direction of travel the train is moving. For example, when the train is moving in a forward direction, the leading rail car is the front or first rail car of the train. Collision attenuator 50 generally includes an energy absorbing assembly 54 which is attached to locomotive 52 by a mounting assembly. The mounting assembly includes mounting arms 56 which are attached to pivots 58 which are movably mounted to brackets 60. These brackets are attached to the train engine 52. A lifting mechanism 62 engages mounting brackets 60 and mounting arms 56 in order to selectively raise and lower collision attenuator 50 with respect to locomotive 52. Due to its overall shape and dimensions which correspond to the standardized rail width of railways, collision attenuator 50 can be used with various types of trains including freight, passenger, and light rail. All that is required is a suitable coupling attachment for mounting the energy absorbing assembly to the leading rail car of the train.

Lifting mechanism 62 is a high speed hydraulic actuator, however, one should appreciate that a suitable electrically or manually operated mechanical actuator can also be used. The hydraulic actuator is a cylinder having a piston. The illustrated actuator includes a piston having a 2 inch diameter and a 2 ft extension, however, one should appreciate that the actual dimensions may vary. Preferably, the piston has a travel rate of approximately 0.1 to 10 ft/sec, preferably 1 to 5 ft/sec, and most preferably 2 ft/sec. High speed lifting mechanism 62 is activated by a switch 68 located in the cab of the train. The attenuator raises into the upright position in approximately 0.1 to 5 seconds, preferably 0.5 to 2.5 seconds, and most preferably in one second.

FIG. 2 shows attenuator 50 with the energy absorbing assembly 54 pivoted up to an upright position. In this upright position the attenuator is clear of objects on the track thus will not be damaged. For example, when a train operator sees an object other than a motor vehicle or pedestrian on the tracks ahead of the train, the operator activates switch 68 causing the high speed lifting mechanism 62 to raise the attenuator 50, thereby preventing damage to the collision attenuator. This keeps the attenuator from being damaged by collisions with miscellaneous objects on found on railroad tracks such as tree branches, rocks, deer, or shopping carts. One should also appreciate that the attenuator can be pivoted up to the upright position in order to clear a coupler 64, allowing coupler 64 to attach to another train car or locomotive. This configuration allows attenuator to be carried on a train car or locomotive in the middle of a train.

Attenuator 50 includes multiple sections 32, 32' and 34 each having a different energy absorbing capacity. Forward section 32 has a relatively low density collapsible material that can absorb the energy of an impact with a small automobile. Forward section 32 preferably has an energy absorbing capacity of approximately 500 to 4000 ft-lbs/ft$^3$, and preferably 1000 to 4000 ft-lbs/ft$^3$. Middle section 32' has a higher density collapsible material that can absorb the energy of an impact with a larger automobile. Middle section 32' preferably has an energy absorbing capacity of approximately 4000 to 8000 ft-lbs/ft$^3$. Trailing section 34 has material with a high energy absorption rate for absorbing the high energies associated with a collision with larger vehicles such as a bus or truck. Trailing section 34 preferably has an energy absorbing capacity of approximately 8000 to 32,000 ft-lbs/ft$^3$, and preferably 8000 to 16,000 ft-lbs/ft$^3$.

A variety of collapsible configurations can be used for each section of the energy absorbing assembly. For example, any one or all of the sections of the energy absorbing assembly can include a collapsible containers filled with a granular material and/or a fluid. Examples of granular material include sand, foam beads, foam block, and other suitable granular material. Similarly, any one or all of the sections can include a collapsible mechanical structure such as a foam block, collapsible containers of fluid, a honeycomb matrix of material such as aluminum, plastic or rubber. The energy absorbing capacity of each sections can be adjusted by changing the size and shape of the collapsible containers, changing the size of the honeycomb sections, and/or by changing the strength of the honeycomb walls. One should appreciate that recycled automobile tires can be used as part of this energy absorbing assembly. One should appreciate that other energy absorbing structures can also be utilized such as hydraulic shock absorbers.

Attenuator 50 also includes an airbag assembly 42 mounted on the front or leading end thereof. Airbag assembly 42 is fluidly connected with an inflation source. Preferably, inflation source is a pressurized gas source, for example, pressurized nitrogen cylinders located in a bay 70, as is schematically shown in FIG. 1. One should appreciate that other suitable inflation sources can be utilized which may be located on the attenuator or, alternatively, on the train. A switch 72 is located in the locomotive cab, or other suitable operator's station, and is operably connected to a valve which fluidly connects the pressurized gas source in the bay 70 to airbag assembly 42. When the train operator detects the presence of a pedestrian or vehicle in the path of the train, the operator actuates the switch which actuates the valve thus allowing the pressurized gas to flow from the source through the valve and into airbag 42. Airbag 42 inflates in approximately 1–10 milliseconds to 10 seconds, preferably in approximately 1–5 seconds and most preferably in approximately 1 second.

FIG. 3 shows airbag assembly 42 actuated and in an inflated configuration. The airbag inflated when the operator activates switch 72 located in the train cab. The airbag contains a large cushioning portion 624 having a leading surface 625 and a pedestrian support portion 622. For the purpose of clarity, "leading surface" refers to the first surface that would contact a pedestrian in the event of a train/pedestrian. Both portions of the airbag have been inflated by the pressurized gas source in bay 70. When the airbag contacts a pedestrian in the path of the train, the force of collision between the pedestrian and cushioning portion 624 increases the pressure in the airbag which causes vents 626 to open. This causes the airbag cushioning portion 624 to partially collapse. The collapsing of the airbag minimizes and/or eliminates the recoil effect of the airbag against the pedestrian and inhibits the pedestrian from bouncing off cushioning portion 624. Pedestrian support portion 622 includes a separate air chamber which is also inflated by the pressurized gas source and stays inflated in order to support the pedestrian thereon after impact. Alternatively, the pedestrian support structure can be in the form of a rigid structure which unfolds and/or extends as the large cushioning portion inflates. Alternatively, the pedestrian support structure can permanently extend forwardly from the collision attenuator. One should appreciate that, in the case that the pedestrian support structure is a rigid structure, it may be a forwardly extending plate made of plastic, plywood, foam, and or other suitable materials.

Also shown in FIG. 3, airbag 42 includes a front center 74 which extends significantly forward relative to the outside edges of the airbag. Front center 74 extends forward approximately 0.5 to 5 feet, and preferably at least 2 feet relative to the outside edges. This configuration provides airbag 42 with a triangular shape in order to impart a lateral acceleration to a pedestrian who is located off center of the airbag in order to deflect the pedestrian out from the path of the train. Similarly, a bottom front portion of the airbag 42 extends forward approximately 0.5 to 5 feet, and preferably 2 feet, relative to the top edge. This configuration provides airbag 42 with a wedge shape in order to impart an acceleration on the lower portion of the pedestrian thus decreasing the probability that the pedestrian will fall down under the attenuator and under the moving train.

Figure 4:
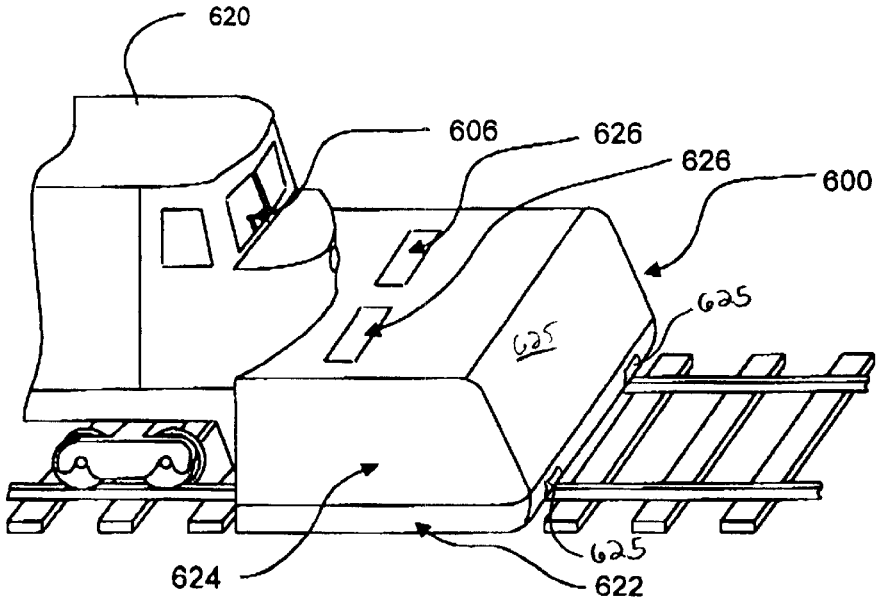
FIG. 4 is a view of an operator actuated airbag system similar to that shown in FIGS. 1–3 in a deployed configuration.

FIG. 4 shows an airbag 600 similar to airbag 42 discussed and described above, attached directly to a train engine 620. Airbag 600 is shown in its inflated state pursuant to an operator activating a switch 606 located in the train cab. Airbag 600 also includes a large cushioning portion 624 and a pedestrian support portion 622. Reenforcing strips 625 are provided on airbag 600 in order to prevent the airbag from tearing on a rail or other object and cause the airbag to partially collapse when the airbag is deployed. When the airbag contacts a pedestrian, the force of collision between the pedestrian and cushioning portion 624 increases the pressure in the airbag causing vents 626 to open in a same manner as described and discussed above in order to minimize and/or eliminate the recoil effect of the airbag against the pedestrian. The train engine mounted airbag is particularly suited for use on trains that run on tracks that do not have grade crossings. A subway system is an example of such a train system.

Figure 5:
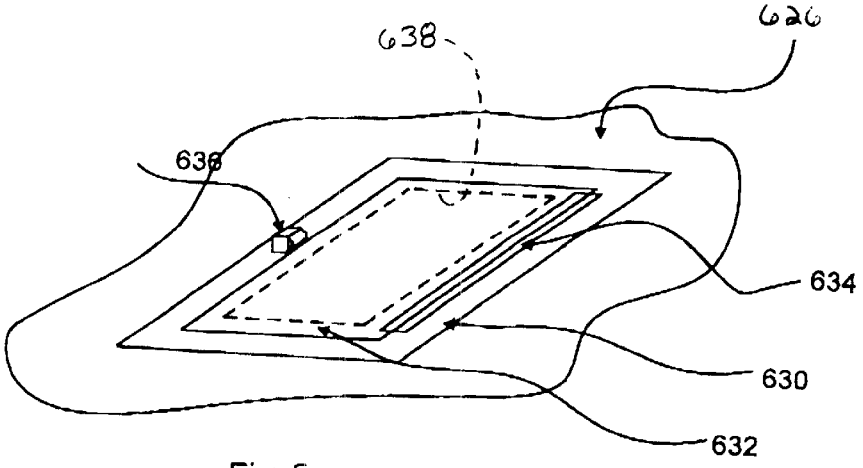
FIG. 5 is a enlarged detailed view of the airbag system of FIG. 4 having an airbag dump valve.

FIG. 5 shows airbag pressure vent 626 which generally includes a vent hole 638 in a surface of airbag 600 and a rigid frame 630 attached to the surface of air bag 600 around a vent hole 638. A vent door 632 is attached to the frame 630 with a suitable hinge 634 and is held closed by spring latch 636. When the pressure in the airbag increases upon impact with the pedestrian, the spring latch 636 releases the vent door 632 which opens and vents the air in the airbag. One should appreciate that other vent hole configurations can be utilized. For example, instead of a rigid frame, a flexible flap or panel can formed in a surface of airbag 600 and attached by Velcro® or other suitable adhesive means in order to close the vent hole.

Figure 6:
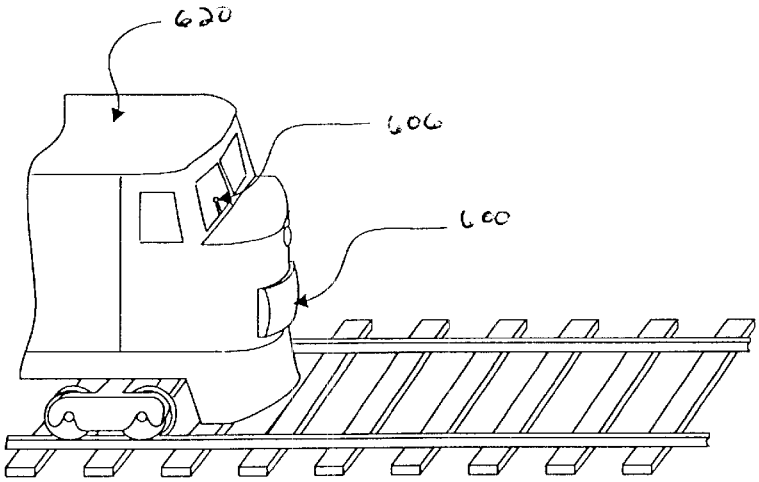
FIG. 6 is a perspective view of the airbag system of FIG. 4 in a non-deployed position.
Figure 7:
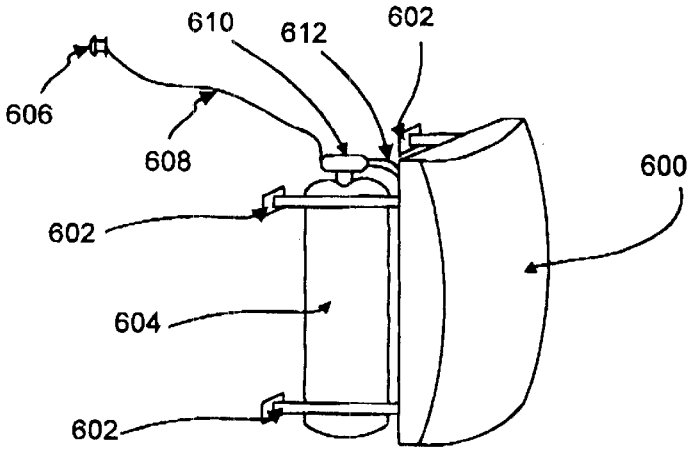
FIG. 7 is an enlarged detailed view of the airbag system of FIG. 6.

FIG. 6 shows airbag 600 mounted directly on the front of a train engine 620 but in its folded, non-deployed configuration. FIG. 7 shows the uninflated airbag 600 that is attached via brackets 602 for attachment to the front of a railway car or locomotive. In this event that airbag 600 is directly attached to locomotive 620 instead of a moveable attenuator assembly a pressurized gas cylinder 604 is also located on locomotive 620. As noted above, a preferred pressurized gas source is a nitrogen gas cylinder, but one should appreciate that other inflation sources can be utilized. One should appreciate that other airbag inflators and valve actuators can be utilized within the scope of the present invention. For example, the valve actuator can be an explosive membrane valve similar to those currently in use in automobile airbags or a mechanically actuated valve such as a ball valve. A proximity sensor can be used in addition to or instead of the operator switch. One or more proximity detectors can be mounted on the airbag, attenuator, train car, and/or locomotive. The proximity detector can be a physical probe, a radar sensor, an infrared sensor, or an ultrasound motion sensor. In such a case, the airbag may be equipped with a speed sensor in order to prevent the air bag from actuating below a predetermined speed. For example, when the radar detects an object ahead of the train, and the train is moving above the predetermined speed, such as faster than 15 mph, the airbag would be activated.

In operation and use, when a train operator sees a pedestrian or railway trespasser in the path of the moving train, the operator presses switch 606 mounted in the train cab. This causes a signal to travel down a wire 608 to a valve assembly 610 thus causing the valve to open allowing the pressurized air in gas cylinder 604 to enter the airbag via a manifold 612. Thus, when the train operator activates an emergency switch 606, airbag 600 is electronically triggered and inflates in a few milliseconds, and remains inflated for several seconds, similar to the airbag inflation systems used in automobiles. The airbag rapidly inflates forming a cushion that reduces the severity of the impact between the train on the pedestrian or railway trespasser.

Figure 8:
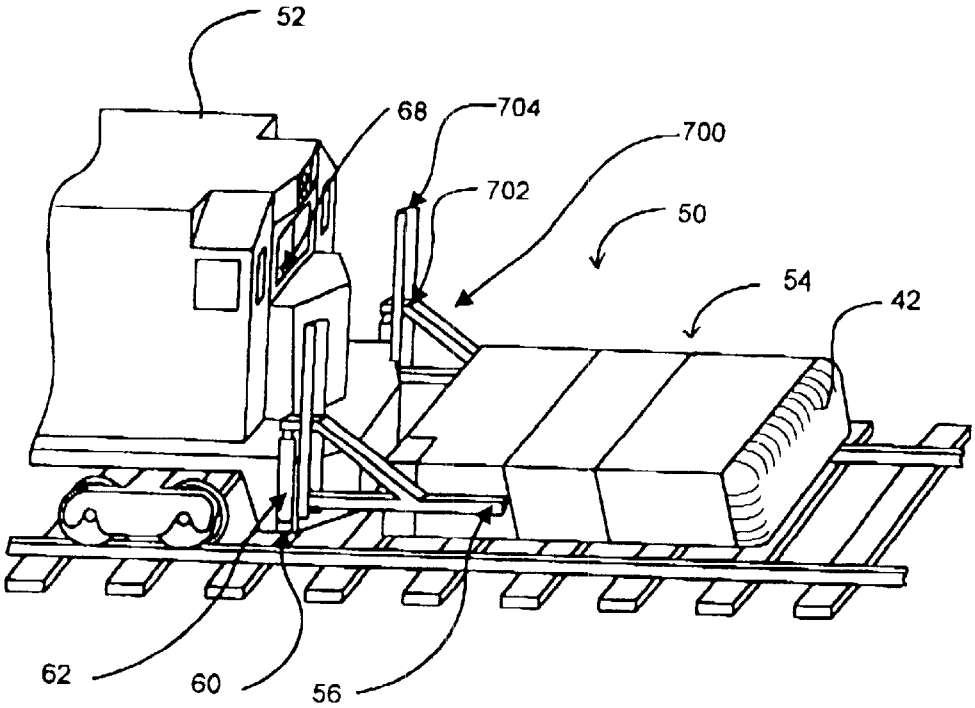
FIG. 8 is a perspective view of a modified collision attenuator, similar to that shown in FIG. 1, in a deployed position.

FIG. 8 shows a railroad train collision attenuator 50 mounted directly on a train engine 52 with a modified vertical lift mechanism 700. The attenuator includes an energy absorbing assembly 54 attached to mounting arms 56 in a similar manner as shown in FIGS. 1–3. Instead of pivoting to an upright position, the collision attenuator shown in FIG. 8 slides up to an elevated position. Specifically, mounting arms 56 are attached to brackets 702 which slide vertically in rails 704. These rails 702 are attached to the train engine 52. Lifting mechanism 62, attaches to the mounting brackets 60, and to the sliding brackets 702. The lifting mechanism 62, is a high speed hydraulic actuator, however, one should appreciate that a suitable electrically or manually operated mechanical actuator can also be used. The hydraulic actuator is preferably a cylinder with an approximately 2 inch diameter piston and an extension of approximately 6 feet, however, one should appreciate that the actual dimensions may vary. Preferably, the piston has a travel rate of approximately 0 to 10 ft/sec, preferably approximately 1 to 8 ft/sec, and most preferably 4 ft/sec. The high lifting mechanism is activated by switch 68 located in the cab of the train.

Figure 9:
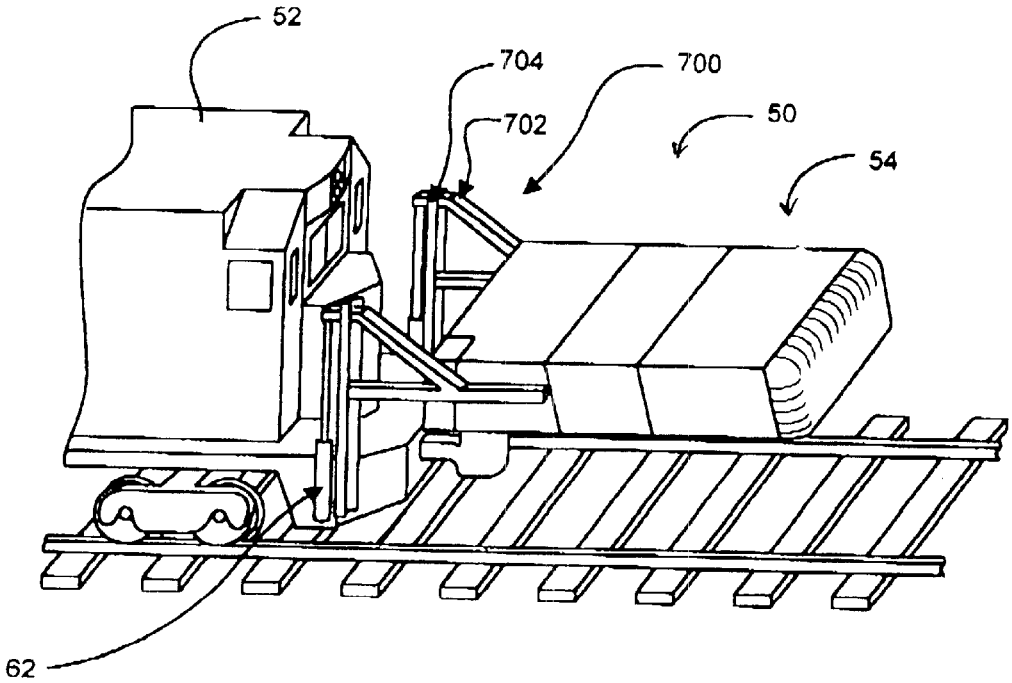
FIG. 9 is a perspective view of the attenuator of FIG. 8 in a raised position.

When the operator sees an object other than a motor vehicle or pedestrian on the tracks ahead of the train, the operator activates switch 68 causing the high speed lifting mechanism 62 to raise the attenuator 50 in approximately 0.1 to 5 seconds, preferably 0.5 to 2.5 seconds, and most preferably in one second. FIG. 9, shows collision attenuator 50 in the raised position. Specifically, hydraulic cylinder 60 is in the extended position having raised bracket 702 to the top of rail 704. In this position, energy absorbing assembly 54 is raised clear of obstacles. This keeps the attenuator from being damaged by collisions with miscellaneous objects on tracks such as tree branches, rocks, deer and other stray animals, or shopping carts.

Figure 10:
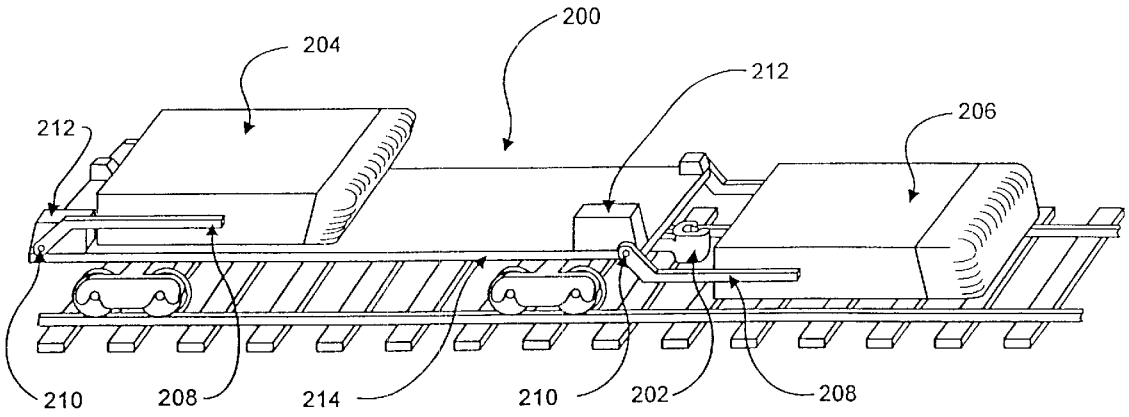
FIG. 10 is a perspective view of a modified collision attenuator in accordance with the present invention similar to the attenuator of FIG. 1 and mounted on each end of a railway car with one attenuator located in a deployed position and the other attenuator in an upright retracted position.

FIG. 10 shows another alternative collision attenuator in accordance with the present invention in which energy absorbing assemblies are mounted on opposing ends of a rail car 200. In particular, rail car 200 is configured as a bi-directional collision attenuator that includes an energy absorbing assembly 204 mounted at one end, and a second energy absorbing assembly 206 mounted at the other end. In addition, a coupler 202 is mounted at each end.

In this embodiment, energy absorbing assembly 204 is in a raised, retracted position and second energy absorbing assembly 206 is in a lowered, deployed position. Each energy absorbing assembly is attached to a pair of mounting arms 208, which are attached by pivot shafts 210 to lifting mechanism 212. Lifting mechanisms 212 are attached to the rail car frame 214 and are otherwise similar to those described and discussed above. An alternative lifting mechanism can include an electric motor with an attached worm gear that drives a gear attached to a pivot shaft 210. The lifting mechanism pivots the energy absorbing assembly between the retracted to the deployed positions. Alternatively, a single attenuator may be provided on the rail car and can be moved from one end of the rail car to the other by a suitable lifting mechanism.

Figure 11:
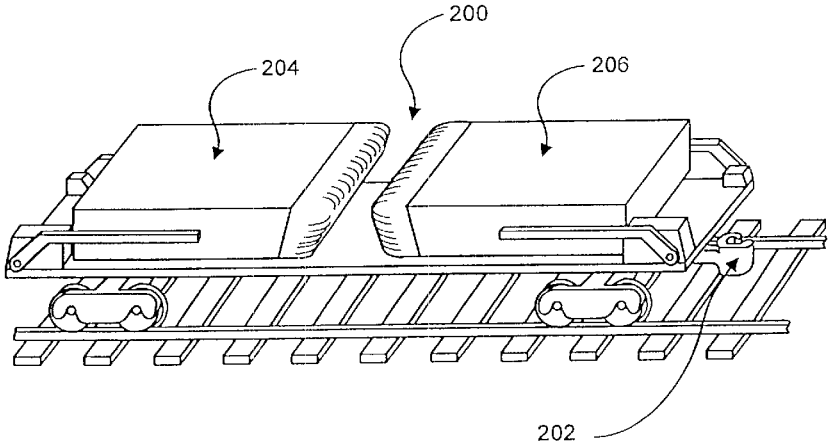
FIG. 11 is a perspective view of the railway car of FIG. 10, with each attenuator shown in its upright retracted position.

FIG. 11 shows the bi-directional collision attenuator 200 of FIG. 10 with both the first and second energy absorbing assemblies 204 and 206 in their respective raised and retracted positions. In this position, coupler 202 is accessible to another rail car thus allowing the rail car 200 to be placed in the middle of a train between other rail cars.

Figure 12:
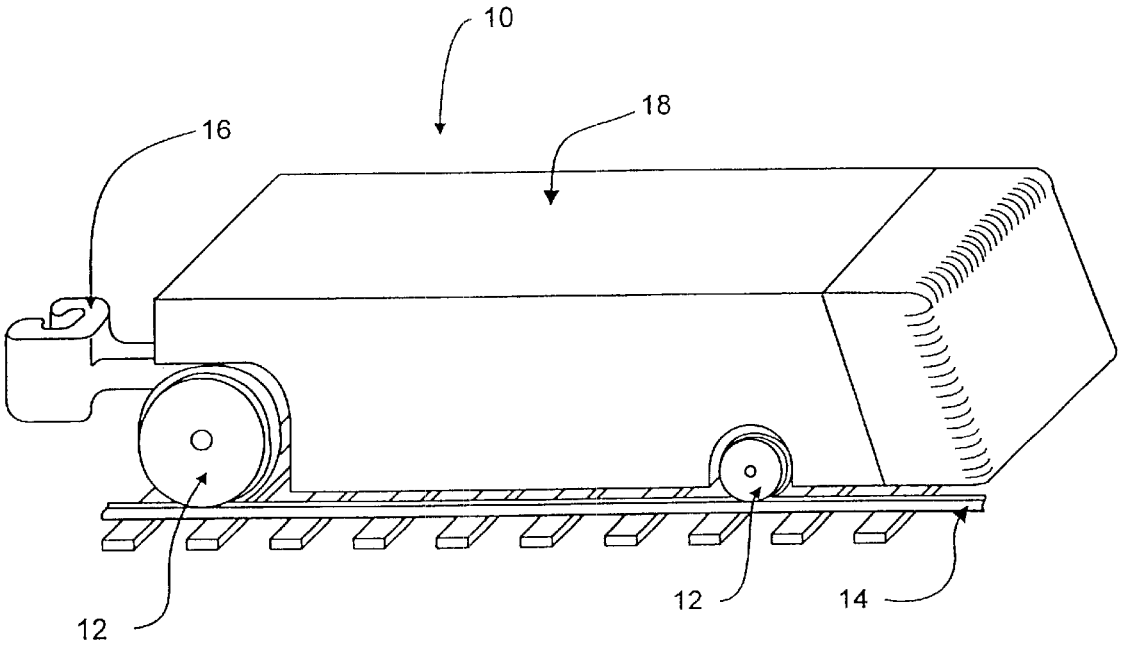
FIG. 12 is a perspective view of a modified collision attenuator in accordance with the present invention.

In one embodiment of the present invention shown in FIG. 12, a collision attenuator rail car 10 includes an elongated energy absorbing assembly 18 supported by standard gauge railway wheels 12 which roll along railway rails 14. A rear coupler 16 is mounted to energy absorbing assembly 18 and is adapted to couple to the front of a railcar, typically the locomotive. In the event of a collision, a pedestrian or a vehicle first contacts the front of energy absorbing assembly 18 instead of the leading train car or locomotive. Energy absorbing assembly 18 begins to collapse upon contact, slowly accelerating or decelerating the pedestrian or vehicle. This significantly reduces collision forces experienced by the pedestrian or vehicle. Furthermore, during a collision with a pedestrian, front section 30 cushions the pedestrian by contacting the lower portions of the pedestrian first, thus reducing the likelihood that the pedestrian will be crushed under the train. Because there is also minimal clearance under car assembly 10, which reduces the likelihood that the pedestrian will be crushed under the train. The clearance between the bottom of car assembly 10 and the railway rails 14 is approximately 2 to 12 inches, and preferably 4 to 6 inches.

Figure 13:
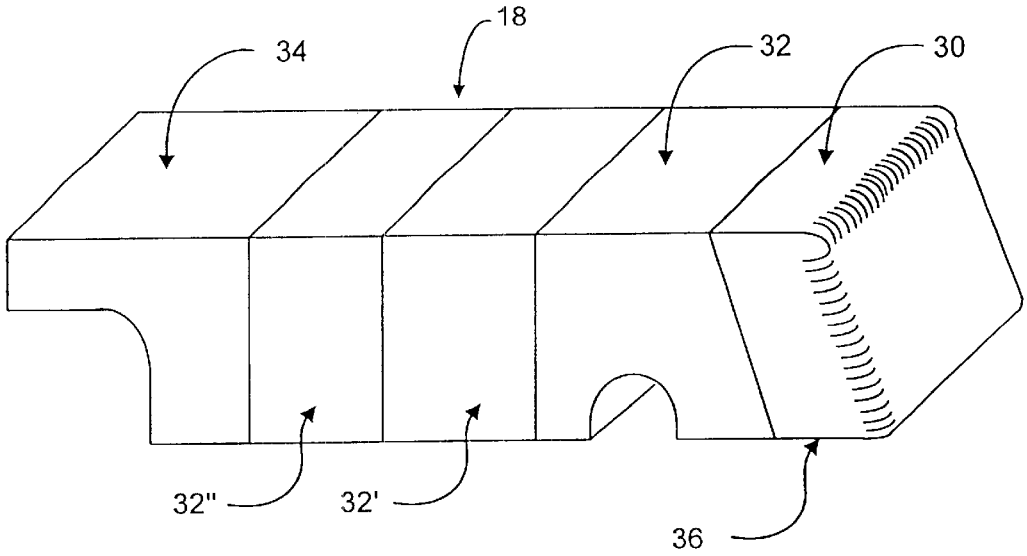
FIG. 13 is a perspective view of a modified collision attenuator in accordance with the present invention similar to the attenuator shown in FIG. 12.

In one embodiment, the collision attenuator rail car includes a plurality of attenuators with differing compression densities. In particular, energy absorbing assembly 18, shown without its wheels in FIG. 13, includes multiple energy absorbing sections 30, 32, 34, each having a different energy absorbing capacity. Front section 30 has a flexible exterior 36, preferably made of a rubber or flexible plastic material. Front section 30 is inflated with a gas and/or is filled with low-density beads or other material, creating, in essence, an inflated air bag. Front section 30 has a very rapid collapse rate suitable for absorbing the force of collision between the rail car and a pedestrian, for example, a collapse rate of approximately 25 to 500 ft-lbs/ft$^3$, and preferably approximately 50 to 250 ft-lbs/ft$^3$.

Middle section 32 is made of a higher density collapsible material than front section 30 and has an energy absorbing capacity sufficient for an impact with an automobile. Middle section 32 is shown to comprise a series of middle sections 32, 32', 32", one or more of which may be provided depending on the energy absorbing requirements for each application. The collapse rate of the middle sections are approximately 500 to 8000 ft-lbs/ft$^3$, and preferably approximately 1000 to 8000 ft-lbs/ft$^3$.

A rear section 34 is made of a material with a high energy absorbing capacity for absorbing the high energies associated with a collision with a larger vehicle such as a bus, truck, or another rail car. The collapse rate of the rear section is approximately 8000 to 32,000 ft-lbs/ft$^3$, and preferably approximately 8000 to 32,000 ft-lbs/ft$^3$. As discussed above, the middle and rear sections can be constructed with collapsible containers of granular material, collapsible containers of fluid, or a collapsible mechanical structure.

Figure 14:
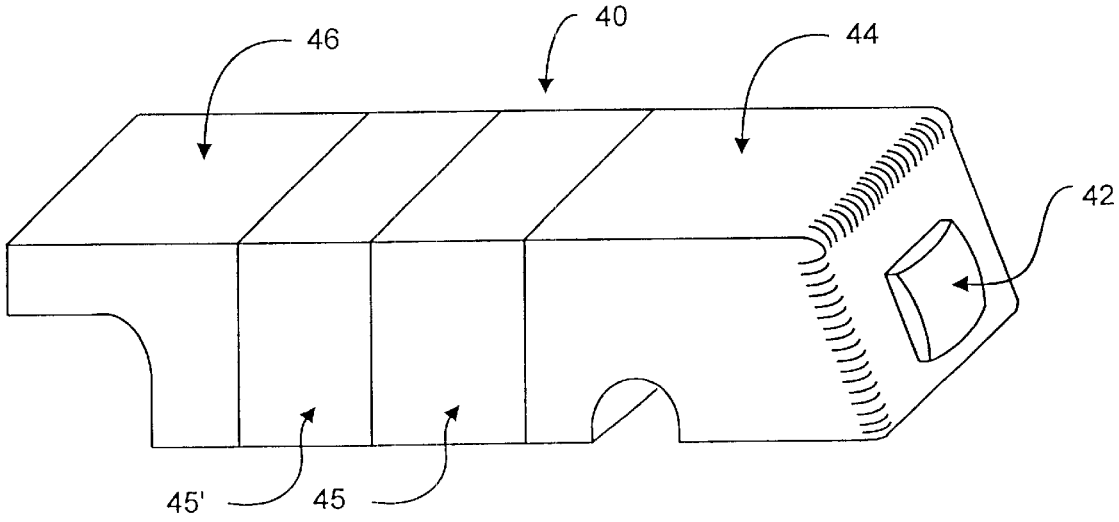
FIG. 14 is a perspective view of a modified collision attenuator in accordance with the present invention similar to the attenuator shown in FIG. 13 and having an airbag.

FIG. 14 shows an alternative embodiment of an energy absorbing assembly 40 of the present invention. Energy absorbing assembly 40 includes a manually or automatically activated airbag 42 located at a front surface of front section 44, which is a medium energy absorbing section configured for absorbing the impact of an automobile in the same manner as sections 32, 32' above. As illustrated, energy absorbing assembly 40 includes additional medium energy absorbing sections 45, 45' and a high energy absorbing section 46. Airbag 42 may be inflated when, for example, an engineer operating the train spots a pedestrian or vehicle on the tracks ahead of the train and actuates an emergency switch mounted in the train controls. When the emergency switch is flipped, the airbag inflates in a few milliseconds. and remains inflated for several seconds in the same manner discussed above.

Figure 15:
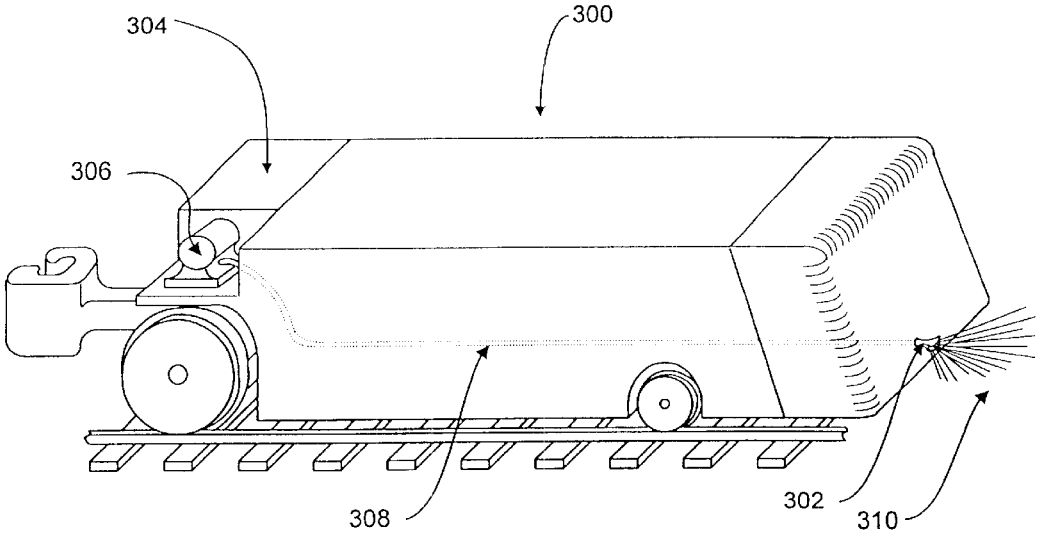
FIG. 15 is a perspective view of a modified attenuator similar to the attenuator of 12 and having a fluid jet pedestrian deflector.

FIG. 15 is an alternative embodiment of a collision attenuator rail car 300 with a fluid jet pedestrian deflection mechanism. A fluid jet nozzle 302 is mounted low on the front of the collision attenuator rail car 300. A fluid tank 304 is mounted on the rail car along with a high pressure fluid pump 306 and a fluid line 308 connects the pump to the fluid jet nozzle 302. When the train engineer actuates an emergency switch located at the train controls, pump 306 activates, pumping the fluid in tank 304 through fluid line 308 and out nozzle 302. Nozzle 302 generates a fan shaped spray of fluid 310 that, when striking a pedestrian on the tracks, accelerates the pedestrian laterally with respect to the train, pushing the pedestrian aside and avoiding a train to pedestrian collision. Examples of fluids that can be used are water and anti-freeze fluids.

Figure 16:
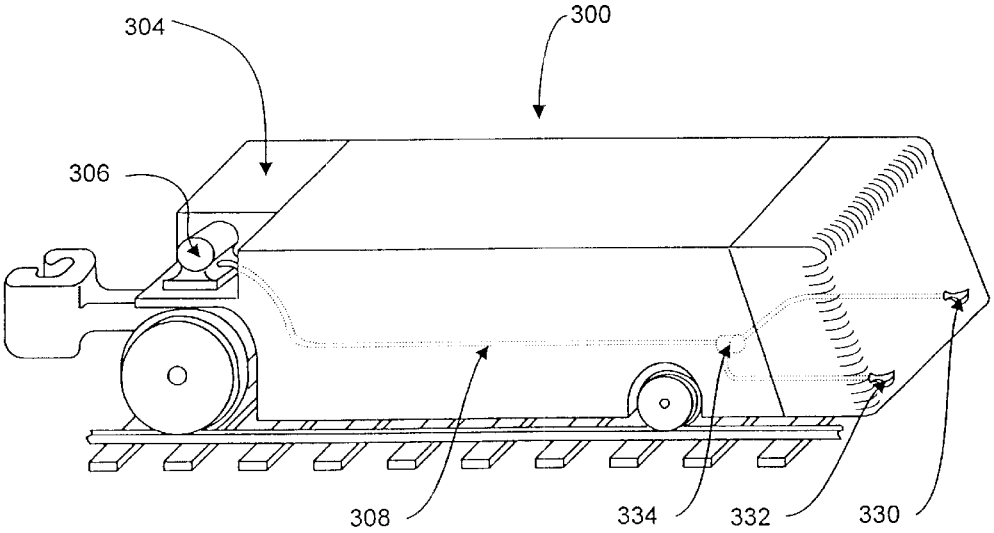
FIG. 16 is a perspective view of a modified attenuator similar to the attenuator of 12 but having a bi-lateral fluid jet pedestrian deflector system.

FIG. 16 is a modified version of collision attenuator rail car 300 with a fluid jet pedestrian deflection mechanism that includes two pedestrian deflector nozzles, a nozzle 330 mounted on the front left of the rail car and a second nozzle 332 mounted on the front right of the car. With dual nozzles, the controls for actuating nozzles 330, 332 include three settings: off, left spray, and right spray. When a right spray is selected, pump 306 activates and valve 334 is set to direct the fluid to the left nozzle 330. This generates a spray generally directed to the right of the rail car 300, which deflects the pedestrian to the right of the train. Similarly, when the controls are set to left spray, pump 306 activates and valve 334 is set to direct the fluid to the right nozzle 332. This generates a spray generally directed to the left of the rail car 300, which deflects the pedestrian to the left of the train. One should appreciate that various configurations including more than two nozzles can be utilized within the scope of the present invention.

Figure 17:
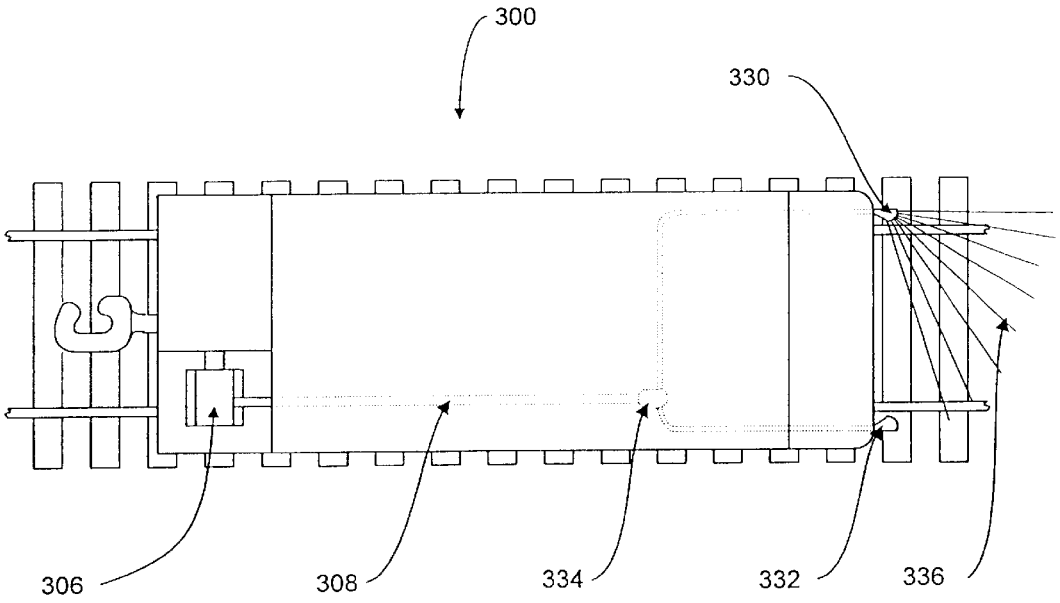
FIG. 17 is a top plan view of the attenuator of FIG. 16.

FIG. 17 is an overhead view of the collision attenuator rail car 300 showing the bi-directional fluid jet pedestrian deflection mechanism of FIG. 16. In this example, the controls are set activating left nozzle 33 to spray fluid toward the right of the vehicle as viewed in FIG. 17. In particular, pump 306 is activated and valve 334 directs fluid to the left nozzle 330 which is pointed in a rightward direction. This generates a spray 336 generally directed to the right of the rail car 300 for deflects a pedestrian in the path of the train toward the right of the train.

Figure 18:
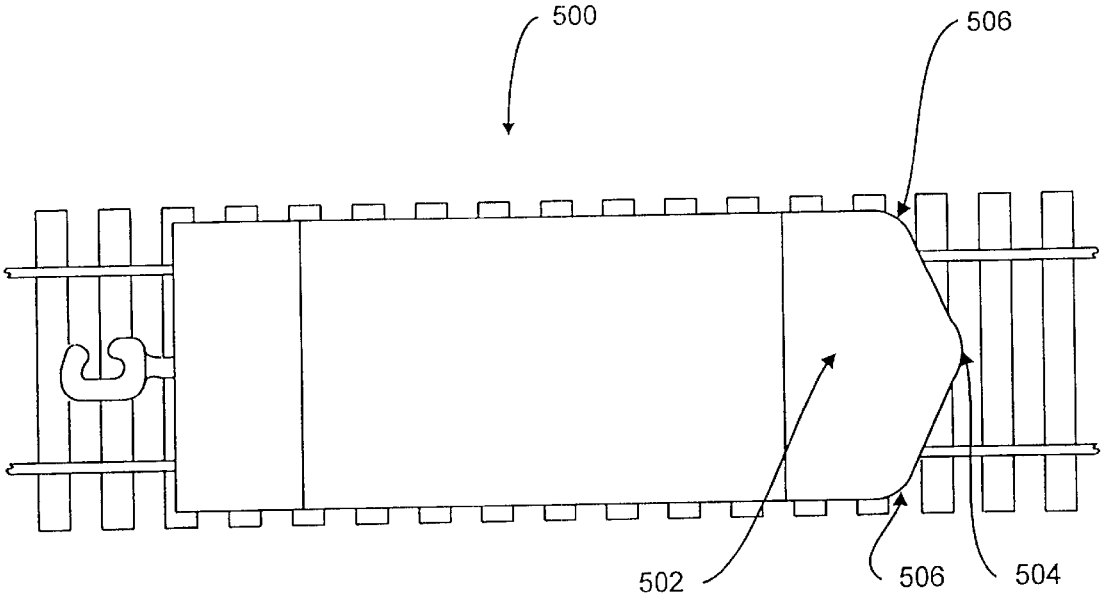
FIG. 18 is a top plan view of a modified airbag system similar to the airbag system in FIG. 4 but shaped to deflect a pedestrian laterally.

FIG. 18 is an overhead view of a modified collision attenuator rail car 500 having front airbag 502 in which a center 504 of the airbag is protrudes significantly forward of edges 506 of rail car 500 in a similar manner as the airbag shown in FIG. 3. Airbag 502 has an angled shape that imparts a lateral acceleration in order to direct a pedestrian who is located off-center of the airbag upon impact out from the path of the train.

Figure 19:
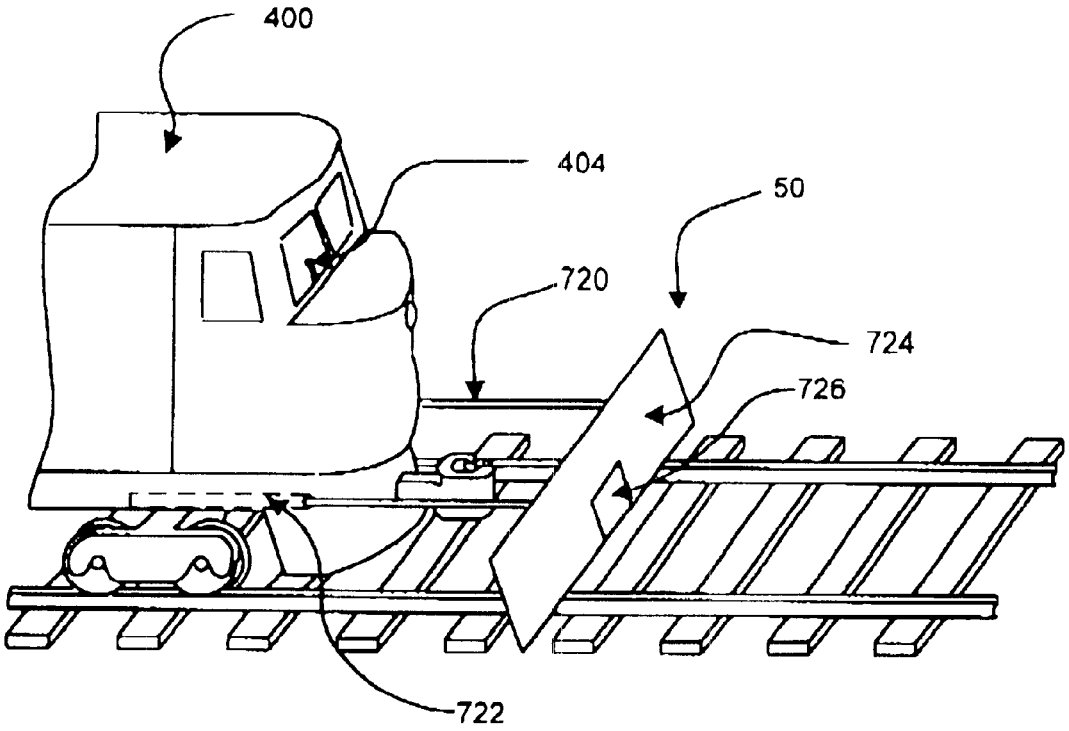
FIG. 19 is a perspective view of a modified collision attenuator in a deployed position.
Figure 20:
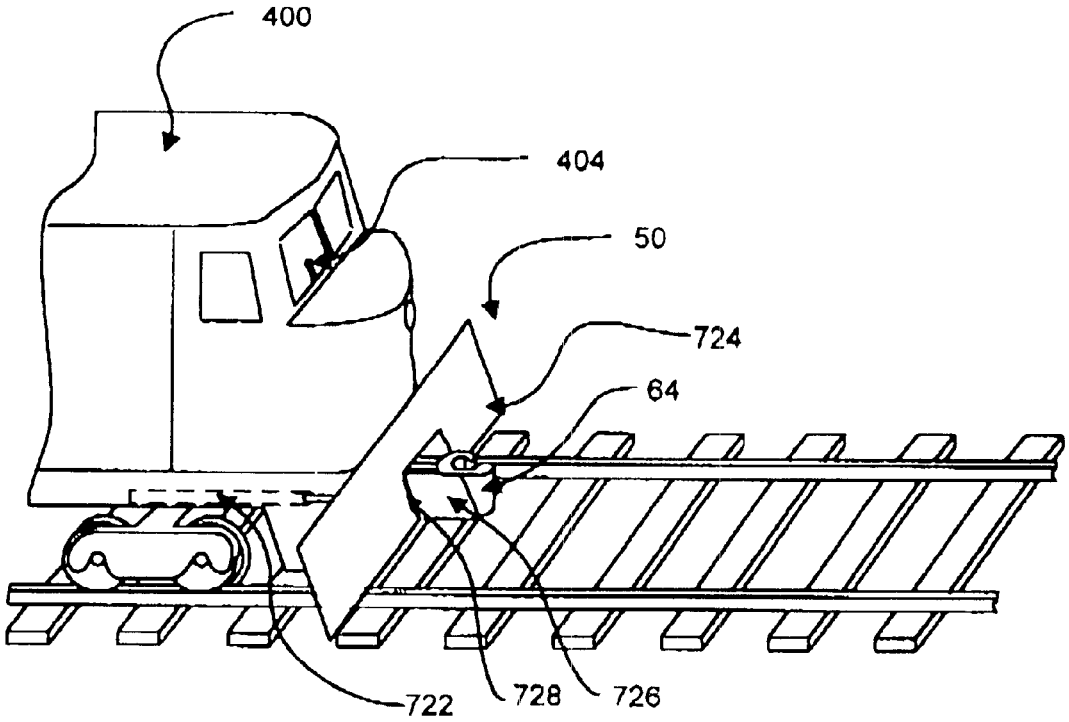
FIG. 20 is a perspective view of the attenuator of FIG. 19 in a retracted position.

In another embodiment shown in FIG. 19 a railway train collision attenuator 50 including a vehicle contact plate 724 is mounted on a train engine 400 via a pair of hydraulic shock absorber cylinders 722. The vehicle contact plate 724 is attached to hydraulic shock absorber pistons 720 which are received by cylinders 722. Vehicle contact plate 724 is formed of a shock absorbing material. For example, vehicle contact plate 724 is preferably a reinforced rubber sheet having a thickness of approximately ¼ to 2 inches, and preferably is approximately ½ inch thick. In the embodiment shown in FIG. 19, a control switch 404 is provided to activate the piston and cylinder assembly and extend pistons 720 forwardly within cylinder 722 thus moving contact plate 724 forwardly from locomotive 400. In the event that the locomotive collides with a vehicle such as an automobile on the tracks, the force of impact between the vehicle and the contact plate is partially absorbed by the material of the contact plate, and partially absorbed as the contact plate 724 moves rearwardly causing pistons 720 to extend into cylinders 722 and moving contact plate 724 toward its retracted position. FIG. 20 shows the railway collision attenuator 50 with the vehicle contact plate 724 in the retracted position. As each piston is depressed into each cylinder 722, the sock absorber assembly partially absorbs the force of collision and reduces the impact forces on the vehicle.

When contact plate 724 is moved toward its retracted position, vehicle contact plate 724 moves behind coupler 64. A coupler door 726 is pushed open by coupler 64 as the vehicle contact plate is retracted. A spring hinge 728 biases coupler door 726 to a closed position thus allowing door 726 to open when contact plate 724 is retracted and closes door 726 when contact plate 724 is deployed.

Figure 21:
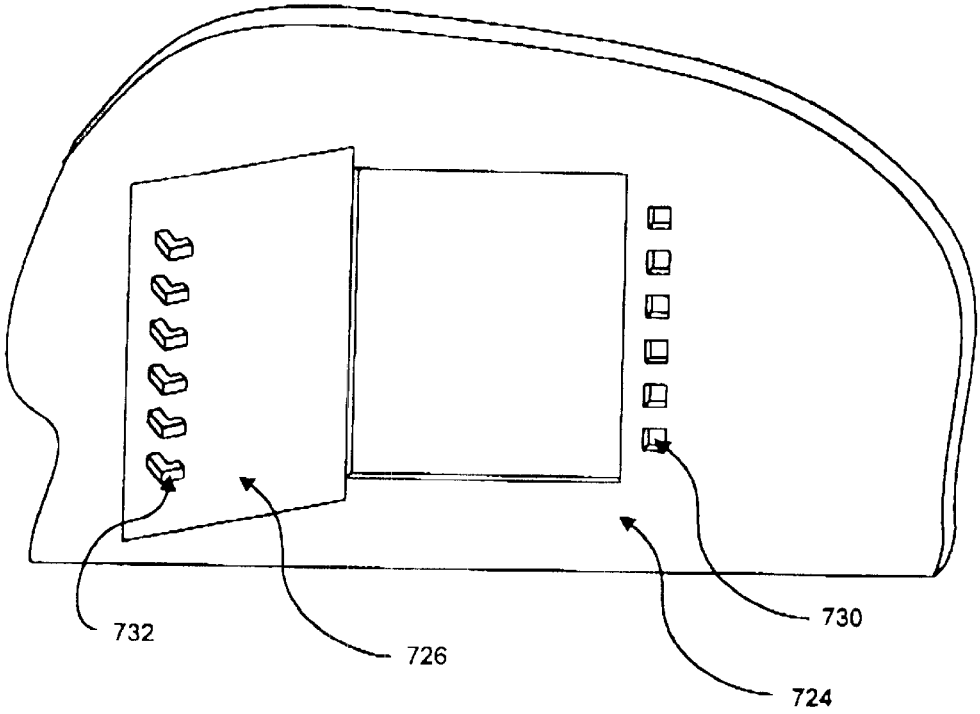
FIG. 21 is an enlarged detailed view of a portion of the attenuator of FIG. 19 showing a coupler door.
Figure 22:
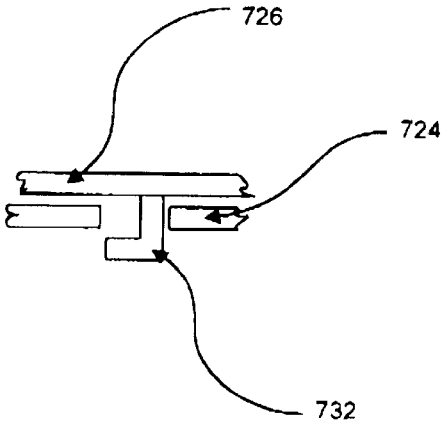
FIGS. 22 and 23 are enlarged detailed views of a coupler door latch for the coupler door of FIG. 20 in unlocked and locked positions, respectively.
Figure 23:
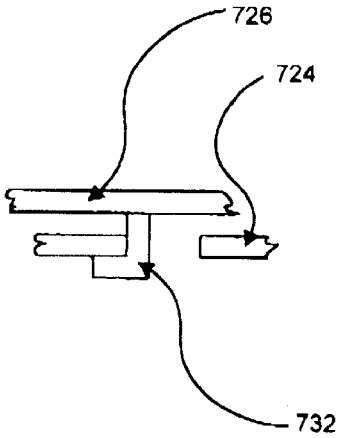

FIG. 21 shows a detailed view of a latch assembly for coupler door 726. Vehicle contact plate 724 has a plurality of holes 730 which cooperate with a plurality of latch pins 732. When the coupler door 726 is closed as shown in FIG. 22, latch pins 732 extend through positioned in holes 730 of plate 724. This allows the door to freely open and close when the plate is retracted or deployed. Door 726 is shifted to a locked position as shown in FIG. 23. In the locked position, a coupler door latch pin 732 extends through a respective hole 730 and engages a portion of plate 724. When the train collides with a vehicle, the vehicle presses against the rubber coupler door 726, stretching it and pulling the latch pins into the locked position.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A train collision attenuator for mounting to a leading end of a leading rail car rollably supported on a railway, said attenuator comprising:

an energy absorbing assembly having a leading surface, said energy absorbing assembly dimensioned and configured for attenuating the force of impact between a moving train and a pedestrian or a vehicle located in the path of the moving train as the pedestrian impacts against said leading surface, a mounting assembly adapted to secure said energy absorbing assembly to the leading end of the leading rail car, and said energy absorbing assembly comprises an airbag, said leading surface being formed by said airbag when said airbag is inflated, said airbag being dimensioned and configured for attenuating the force of impact between the moving train and the pedestrian or the vehicle, said airbag including an upper pedestrian cushioning portion and a lower pedestrian support portion, wherein said lower pedestrian support portion has a deployed shape and said lower pedestrian support portion maintains its shape while said upper cushioning portion deflates.

2. A train collision attenuator for mounting to a leading end of a leading rail car rollably supported on a railway, said attenuator comprising:

an energy absorbing assembly having a leading surface, said energy absorbing assembly dimensioned and configured for attenuating the force of impact between a moving train and a pedestrian and between a moving train and a vehicle located in the path of the moving train as the pedestrian or the vehicle impacts against said leading surface, a mounting assembly adapted to secure said energy absorbing assembly to the leading end of the leading rail car, and said attenuator is adapted for mounting to a leading end of the leading rail car proximal a train coupling mechanism of the rail car, said mounting assembly includes a lifting mechanism wherein said energy absorbing assembly is adapted to be moved up and away from the train coupling mechanism from a deployed position to a retracted position in less than approximately 2.5 seconds.

3. The train collision attenuator of claim 2 wherein said energy absorbing assembly comprises an airbag, said leading surface being formed by said airbag when said airbag is inflated, said airbag being dimensioned and configured for attenuating the force of impact between the moving train and the pedestrian.

4. The train collision attenuator of claim 3 wherein said airbag further comprises an upper pedestrian cushioning portion and a lower pedestrian support portion for supporting the pedestrian after impact.

5. A train collision attenuator mounted to a leading end of a leading rail car rollably supported on a railway, said attenuator comprising:

an energy absorbing assembly having a leading surface, said energy absorbing assembly dimensioned and configured for attenuating the force of impact between a moving train and a pedestrian and between a moving train and a vehicle located in the path of the moving train as the pedestrian or the vehicle impacts against said leading surface, a mounting assembly adapted to secure said energy absorbing assembly to the leading end of the leading rail car, said energy absorbing assembly comprises a first energy absorbing section located adjacent said leading surface, said first energy absorbing section is dimensioned and configured for attenuating the force of impact between the moving train and the pedestrian, said first energy absorbing section having an energy absorption coefficient of approximately 25 to 500 ft-lbs/$ft_3$, and said energy absorbing assembly further comprises a second energy absorbing section dimensioned and configured for attenuating the force of impact between the moving train and an automobile, said second section having an energy absorption coefficient of approximately 500 to 4000 ft-lbs/$ft^3$.

6. The train collision attenuator of claim 5 wherein said energy absorbing assembly further comprises a third energy absorbing section dimensioned and configured for attenuating the force of impact between the moving train and a truck or bus, said third section having an energy absorption coefficient of approximately 8000 to 32,000 ft-lbs/$ft^3$.

7. The train collision attenuator of claim 5 further comprising an airbag including an upper pedestrian cushioning portion and a lower pedestrian support portion.

8. The train collision attenuator of claim 5 further comprising a fluid-spray pedestrian deflector wherein said deflector sprays a fluid laterally with respect to the direction of travel of the train in order to deflect the pedestrian from the path of the train.

9. A train collision attenuator for mounting to a leading end of a leading rail car rollably supported on a railway, said attenuator comprising:

an energy absorbing assembly having a leading surface, said energy absorbing assembly dimensioned and configured for attenuating the force of impact between a moving train and a pedestrian located in the path of the moving train as the pedestrian impacts against said leading surface, a mounting assembly adapted to secure said energy absorbing assembly to the leading end of the leading rail car, and said energy absorbing assembly comprises an airbag, said leading surface being formed by said airbag when said airbag is inflated, said airbag being dimensioned and configured for attenuating the force of impact between the moving train and the pedestrian and including an upper deflatable portion and a lower pedestrian support portion for supporting the pedestrian after impact.

10. The train collision attenuator of claim 9 wherein said airbag inflates within approximately 5 milliseconds to 10 seconds.

11. The train collision attenuator of claim 9 further comprising a proximity detector configured for detecting obstacles within the path of the train.

12. The train collision attenuator of claim 9 wherein said leading surface comprises a center portion and side portions, said center portion protruding further forward than said side portions and being configured and dimensioned to laterally deflect the pedestrian from the path of the train.

13. The train collision attenuator of claim 9 further comprising an air pressure dump valve configured and dimensioned allow deflation of the airbag upon impact with the pedestrian or the vehicle.

14. In combination, a train collision attenuator and a train, said train including a leading rail car having a leading end to which said collision attenuator is mounted, said collision attenuator comprising:

an energy absorbing assembly having a leading surface, said energy absorbing assembly dimensioned and configured for attenuating the force of impact between said train while it is in motion and a pedestrian or a vehicle located in the path of said train as the pedestrian or vehicle impacts against said leading surface, and a mounting assembly securing said energy absorbing assembly to said leading end of said leading rail car, wherein said attenuator is mounted to said leading end of said leading rail car proximal a train coupling mechanism of said rail car, said combination further comprising a lifting mechanism wherein said energy absorbing assembly is adapted to be moved up and away from said train coupling mechanism from a deployed position to a retracted position in less than approximately 2.5 seconds.

15. The combination of claim 14, said train collision attenuator further comprising a lower pedestrian support portion for supporting the pedestrian after impact.

* * * * *